United States Patent [19]

Phipps

[11] Patent Number: 4,502,102

[45] Date of Patent: Feb. 26, 1985

[54] COMBINATION FLASHLIGHT AND LAMP

[76] Inventor: Henri L. Phipps, Phipps Enterprises, 53 W. Fordham Rd., Bronx, N.Y. 10468

[21] Appl. No.: 585,275

[22] Filed: Mar. 1, 1984

[51] Int. Cl.[3] ..... F21L 7/00

[52] U.S. Cl. ..... 362/183; 362/184; 362/186; 362/205; 362/251; 362/399; 362/414

[58] Field of Search ..... 362/183, 184, 186, 205, 362/251, 399, 414

[56] References Cited

U.S. PATENT DOCUMENTS

| | | | |
|---|---|---|---|
| 4,029,954 | 6/1977 | Moyer | 362/183 |
| 4,096,553 | 6/1978 | Roche | 362/183 |
| 4,322,782 | 3/1982 | Wong | 362/183 |
| 4,428,033 | 1/1984 | McBride | 362/183 |

*Primary Examiner*—Stephen J. Lechert, Jr.
*Attorney, Agent, or Firm*—Richard L. Miller

[57] ABSTRACT

A combination flashlight and lamp which may be used in fixed position as a table lamp. Lamp section may be removed and the instant invention becomes a powerful flashlight. Rechargeable batteries contained in the flashlight section are maintained at full charge by a built-in battery charger. The invention is aesthetically pleasing and can be modified to fit most room decors. Several mechanisms for rapid assembly and disassembly are provided. The base of the lamp, which is actually the flashlight section may be made of a translucent material so that, when the invention is used as a table lamp and the flashlight is activated, the base of the lamp will grow creating a special decoration feature.

5 Claims, 5 Drawing Figures

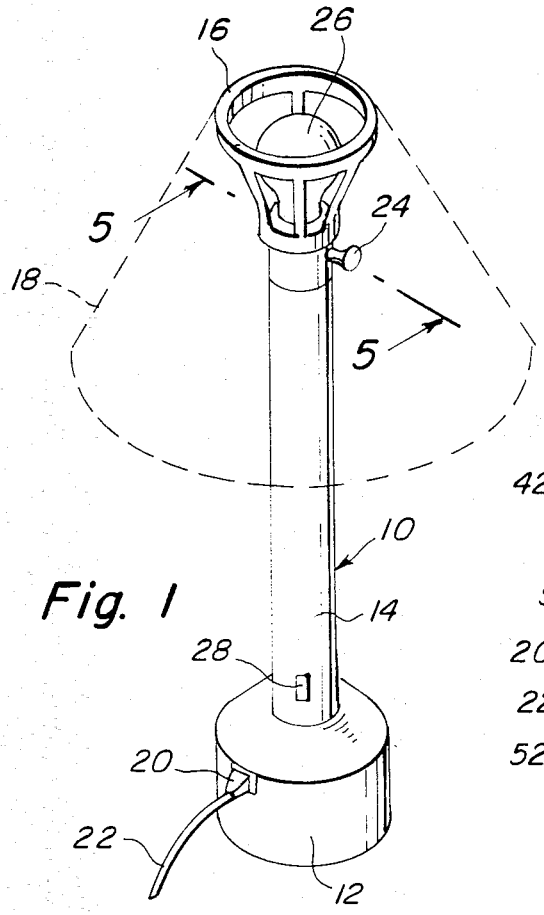
Fig. 1
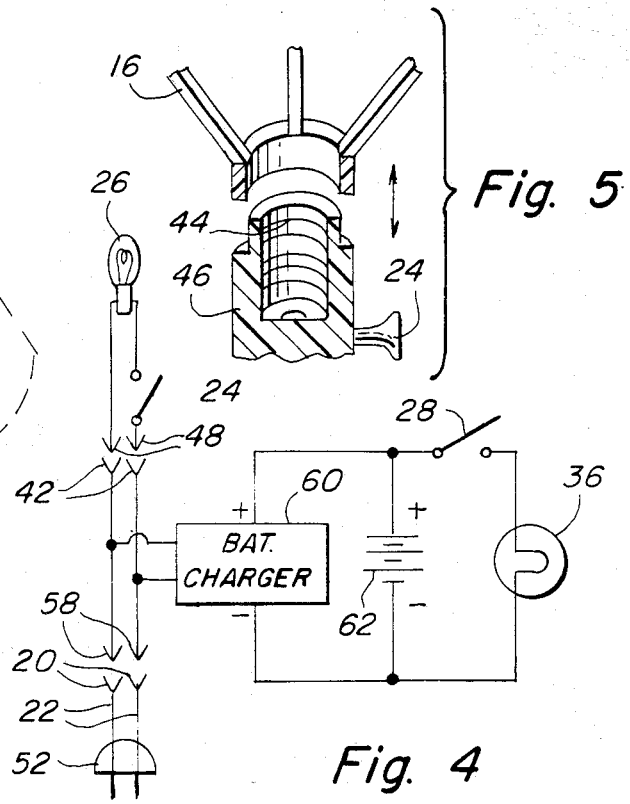
Fig. 5
Fig. 4
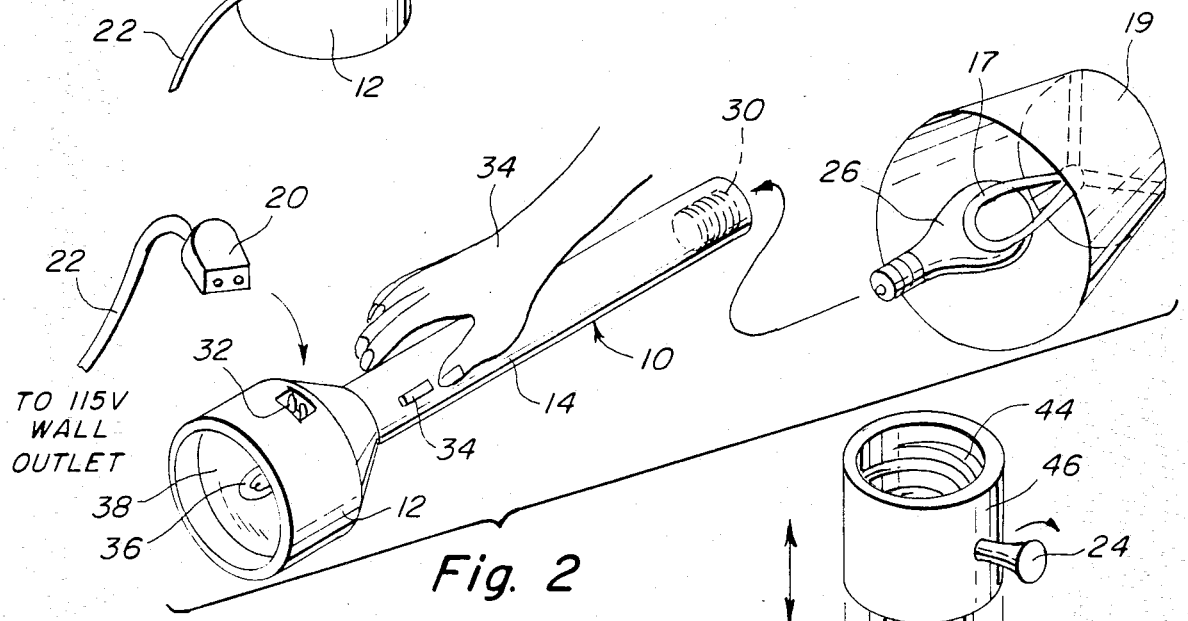
Fig. 2
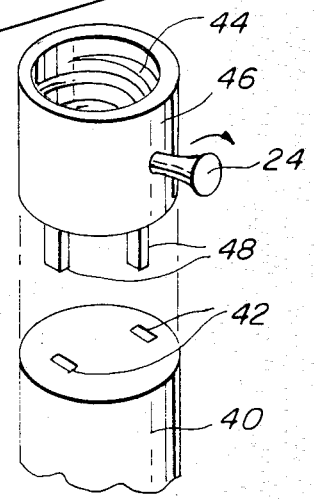
Fig. 3

COMBINATION FLASHLIGHT AND LAMP

BACKGROUND OF THE INVENTION

The present invention relates generally to light providing devices and more specifically to combinations of lighting devices which are useful for both indoor and outdoor use.

Flashlights, as currently used, contain internal power sources, usually in the form of primary, non-rechargeable batteries or secondary, rechargeable batteries. They are usually light in weight, may be waterproof and have switch in the power path between the battery and the flashlight bulb. Lamps, on the other hand, usually run off an A.C. power source and are rather heavy, and bulky due to their lamp shade.

There are many good reasons to have a flashlight readily at hand. For example, during power outages, which occur frequently in many areas, life and limb may be endangered unless some form of emergency lighting may be restored.

Additionally, many people store flashlights in anticipation of an emergency and forget to replace batteries on a regular basis, thereby rendering the flashlight useless at its time of greatest need.

When a flashlight is needed suddenly, particularly when no other light source is available, the flashlight may be difficult to find. Stress increases the difficulty of remembering where to look for the flashlight when usual visual cues are greatly altered or non-existent.

SUMMARY OF THE INVENTION

It is, therefore, a primary object of the present invention to provide a combination flashlight and lamp in which the lamp, when in normal use sits upon some flat surface, is plugged into a wall receptacle and may be turned on and off by an electrical switch.

Another object is to provide a combination flashlight and lamp in which the lamp section may be easily removed from the flashlight section, which acts as the base of the lamp. The flashlight may, then be used as as independent source of transportable light. This feature makes certain that the flashlight is easily locatable since most people are accustomed to locating their lamps in the dark since it is often necessary to turn lamps on in an unlit room.

A further object is to provide a combination flashlight and lamp when which used as a lamp constantly causes the flashlight batteries to be recharged. This makes certain that the flashlight is always ready to operate.

A yet further object is to provide a combination flashlight and lamp which is aesthetically pleasing and may be modified to fit the decor of any room yet still retain the basic spirit of the instant invention.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention being used as a lamp.

FIG. 2 is a perspective view of the invention being used as a flashlight and showing how the other parts of the lamp may be removed as necessary.

FIG. 3 is a modification showing an exploded partial perspective view of a plug-in lamp portion.

FIG. 4 is a schematic block diagram of one embodiment of the invention.

FIG. 5 is an enlarged partial cross sectional view taken on line 5—5 of FIG. 1, to further clarify constructional details.

DETAILED DESCRIPTION OF THE PREFERRED EMBODIMENTS

In FIG. 1, the invention 10 is shown being used as a table lamp. The flared base 12 with its handle section 14 supports lamp shade mount 16. A lamp shade 18, shown in phantom, is in turn supported by the lamp shade mount 16. Line cord plug 20, with associated line cord 22 supplies power to the lamp. When the knob on lamp switch 24 is rotated, power is applied to lamp bulb 26 which then lights. Although an incandescent bulb is shown any kind of bulb of electrically operated light emitting device might also be used. Flashlight on-off switch 28 would not ordinarily be used while the invention is being used as a table lamp, however, if the base 12 is made of a translucent material, then when flashlight on-off switch 28 is actuated, the base 12, of the lamp, will glow creating an aesthetically pleasing effect.

In FIG. 2, the invention 10 is being prepared for use as a flashlight. First, lamp bulb 26 together with associated lamp shade mount 17 and lamp shade 19 are removed by unscrewing lamp bulb 26 from lamp socket 30. Line cord plug 20 is then unplugged from line cord socket 32. A hand 34 is shown holding the invention 10 by grasping handle 14. When combination on-off switch is switched to the on-flashlight position flashlight bulb 36, protected by flashlight lens 38, is illuminated. Switch 34 is referred to as a "combination on-off" switch, because, in this embodiment, one switch is used to control both the lamp and the flashlight since the lamp bulb 26 does not have its own dedicated switch.

In FIG. 3, an alternative technique of separating and connecting the lamp from the flashlight is shown. The top of handle 40 has a plug-in lamp socket receptacle 42 built into it. A bulb engages the threads 44 of a detachable lamp socket 46. To assemble the lamp section to the flashlight section of the invention 10 lamp socket plug 48 is plugged into lamp socket receptacle 42. When the knob on lamp switch 24 is rotated the lamp will light.

The internal electrical construction of the invention may best be understood by reference to FIG. 4. Power input to the device is via power plug 52, line cord 22, line cord plug 20, and line cord receptacle 58. Since power is applied constantly to battery charger 60, the rechargeable battery 62 will always be maintained at full charge. When flashlight switch 28 is activated flashlight lamp 36 will light. Power is conducted from the flashlight section to the lamp section via lamp socket receptacle 42 and lamp socket plug 48. When lamp switch 24 is activated lamp bulb 26 lights.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination flashlight and lamp, comprising in combination: an elongated handle, a flared head portion at one end thereof for receiving a flashlight bulb, a removable lamp socket means at the other end of said elongated handle for receiving a lamp bulb, a flashlight switch positioned along said elongated handle for turning on and off of said flashlight bulb, a lamp switch contained in said lamp socket means for turning on and off of said lamp bulb, a plug contained in said flashlight for removably receiving a line cord from an AC power source for energizing said lamp bulb, a battery charger contained in said elongated handle for charging a rechargeable battery in said elongated handle which battery energizes the flashlight bulb, said battery charger being operated from the line cord, whereby with said flared head portion serving as a base and said handle serving as a post, said combination operates as a fixed lamp which also recharges the flashlight battery, and upon removal of the line cord and the lamp socket means, said combination operates as a portable flashlight.

2. A combination flashlight and lamp, as recited in claim 1, wherein said lamp socket means comprises a detachable lamp socket, the bottom of which contains a lamp socket plug mounted to the bottom of said detachable lamp socket and a matching lamp socket receptacle mounted to the top of said elongated handle, whereby said detachable lamp socket with said lamp bulb may simply be plugged into and unplugged from said handle which handle acts as a base.

3. A combination flashlight and lamp, as recited in claim 2, wherein said plug and said lamp socket matching socket are configured to match electrical receptacles installed as power outlets in a user's electrical power system.

4. A combination as recited in claim 1, wherein said lamp socket means comprises a threaded lamp socket recessed into the top of said handle, whereby said lamp bulb may simply be screwed or unscrewed from said handle which handle acts as a base.

5. A combination as recited in claims 1, wherein said flared head portion comprises a flattened face area and wherein said flared head portion is of sufficient weight and dimension as to prevent said combination flashlight and lamp from tipping over when utilized as a lamp.

* * * * *